US008528716B2

(12) United States Patent
Lanzki et al.

(10) Patent No.: US 8,528,716 B2
(45) Date of Patent: Sep. 10, 2013

(54) DEVICE FOR CONNECTING A CHAIN TO A STEP OR A PALLET OF A PASSENGER CONVEYING INSTALLATION

(75) Inventors: Winfried Lanzki, Unna (DE); Carsten Rolf, Sprockhoevel (DE); Andreas Tautz, Waltrop (DE); Alfred Thiel, Sprockhoevel (DE); Heinrich Zeiger, Muenster (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/352,967

(22) Filed: Jan. 18, 2012

(65) Prior Publication Data

US 2012/0181142 A1 Jul. 19, 2012

Related U.S. Application Data

(63) Continuation of application No. PCT/EP2010/003863, filed on Jul. 1, 2010.

(30) Foreign Application Priority Data

Jul. 18, 2009 (DE) ..... 10 2009 033 819

(51) Int. Cl.
*B66B 23/12* (2006.01)

(52) U.S. Cl.
USPC ..... 198/333; 198/849

(58) Field of Classification Search
USPC ..... 198/326, 333, 845, 849
See application file for complete search history.

(56) References Cited

U.S. PATENT DOCUMENTS

| | | | | | |
|---|---|---|---|---|---|
| 2,292,534 | A * | 8/1942 | Margles | 198/333 |
| 4,232,783 | A * | 11/1980 | Kraft | 198/851 |
| 5,101,965 | A * | 4/1992 | Rutz et al. | 198/803.7 |
| 5,137,135 | A * | 8/1992 | Pietsch et al. | 198/332 |
| 5,468,376 | A * | 11/1995 | Bates | 210/160 |
| 5,697,487 | A * | 12/1997 | Engelke et al. | 198/333 |
| 5,785,166 | A * | 7/1998 | Hoefling et al. | 198/330 |
| 5,806,653 | A * | 9/1998 | Ahls et al. | 198/326 |
| 6,085,891 | A * | 7/2000 | Behle | 198/333 |
| 6,405,848 | B1 * | 6/2002 | Babler | 198/333 |
| 2006/0083451 | A1 * | 4/2006 | Kawagoe et al. | 384/276 |
| 2010/0206692 | A1 * | 8/2010 | Matheisl et al. | 198/333 |

FOREIGN PATENT DOCUMENTS

| | | |
|---|---|---|
| EP | 1 106 562 A1 | 6/2001 |
| JP | 5 201675 A | 8/1993 |

OTHER PUBLICATIONS

International Search Report issued in PCT/EP2010/003863 dated Nov. 10, 2010.

* cited by examiner

*Primary Examiner* — Gene Crawford
*Assistant Examiner* — Keith R Campbell
(74) *Attorney, Agent, or Firm* — Venable LLP; Robert Kinberg; Tamatane J. Aga

(57) ABSTRACT

A device for connecting a chain, which is actively connected to a roller, to a step or a pallet of an escalator or a moving walkway, respectively. The chain has a roller side and a step or pallet side. The device includes a hollow stud disposed on the roller side and a cylindrical shoulder disposed on the step or pallet side. The hollow stud has a clearance to receive the cylindrical shoulder. A slide bearing is arranged at least radially between a circumferential surface of the hollow stud defining the clearance and an outer circumferential surface of the shoulder.

8 Claims, 2 Drawing Sheets

DEVICE FOR CONNECTING A CHAIN TO A STEP OR A PALLET OF A PASSENGER CONVEYING INSTALLATION

CROSS-REFERENCE TO RELATED APPLICATIONS

This application is a continuation of PCT/EP2010/003863, filed Jul. 1, 2010, designating the United States and claiming priority to German application No. DE 10 2009 033 819.5, filed Jul. 18, 2009, the contents of both applications being incorporated herein by reference in their entireties.

BACKGROUND OF THE INVENTION

The invention relates to a device for connecting a chain, in particular a plate link chain, which is actively connected to a roller, to a step or a pallet of an escalator or a moving walkway.

EP 1 106 562 A1 relates to an escalator step which is preferably made of fiber reinforced synthetic material and which presents an improved stability or reduced bending stress while being loaded. For this purpose, at least one support bearing is provided on the escalator step by which the escalator step is positively connected to a connection axis which is attached to step chains.

U.S. Pat. No. 6,405,848 B1 discloses an escalator step comprising an integrated guiding roller and associated connection means. The escalator step comprises a shoulder which extends outwards in the area of the front faces, on which shoulder the roller which is provided with a bearing can be placed. The connection is realized by a moulded spring element and a self-cutting screw which can be inserted into a recess provided in the shoulder.

DE 43 34 064 A1 discloses a drive system for the steps and pallets of escalators and moving walkways, composed of transport chains which are respectively arranged laterally on the steps or pallets and which comprise a plurality of chain studs which interact with bushes and which are at least partially connected to the steps or pallets. Outer brackets are provided in a rotation resistant manner on the chain studs and inner brackets are provided in a rotation resistant manner on the bushes, wherein sealing elements are arranged in the area of both front faces. The chain studs are formed by electrocoated carburized steel studs, whereas the studs are made of carburized tempering steel having a galvanic coating. At least one slide bearing, which is formed by a thin-walled, eventually fiber-reinforced plastic bush, extends between the chain studs and the bushes. A thin lubricating film can be applied as initial lubrication between the chain studs and the slide bearing.

SUMMARY OF THE INVENTION

It is an object of the invention to propose an alternative connection between the chain and the step/pallet of an escalator or a moving walkway, which connection has a simplified structure in comparison to the state of the art.

The above and other objects are achieved by a device for connecting a chain, which is actively connected to a roller, to a step or a pallet of an escalator or a moving walkway, respectively, the chain having a roller side and a step or pallet side, the device comprising; a hollow stud disposed on the roller side and a cylindrical shoulder disposed on the step or pallet side, the hollow stud having a clearance to receive the cylindrical shoulder; and a slide bearing arranged at least radially between a circumferential surface of the hollow stud defining the clearance and an outer circumferential surface of the shoulder.

Steps and pallets of escalators or moving walkways are often made of die cast aluminium, such that the cylindrical shoulder is part of a step or pallet connector integrated in the step or pallet.

It is advantageous if the respective slide bearing is tube-shaped and, in the area of its circumferential extension, comprises several recesses which extend from the outer towards the inner circumferential surface of the tube, in which recesses a lubricant, for example fat, is embedded.

Depending on the field of application, the first insertion of the lubricant can also be regarded as permanent lubrication.

If this is not sufficient, a further lubricant supply can be assured, if required, by a lubrication nipple.

In order to prevent external filth from getting into the area of the slide bearing a radially acting sealing element may be positioned outside the slide bearing in the area of the steps or pallets.

According to another aspect of the invention, the step or pallet connector may comprise an enlarged portion on the step or pallet side, wherein a disk which is positioned on the shoulder is axially provided between the enlarged portion and the free end of the hollow stud.

If the chain is a plate link chain, an outer protection roll and an inner chain bush are still provided, apart from individual plates, in the area of the plate link chain, wherein the chain bush is actively connected to the outer circumferential surface of the hollow stud by a sliding body.

As an analogue to the already explained slide bearing which extends within the clearance between the hollow stud and the shoulder, a correspondingly formed sliding body can also be used on the side of the plates.

The sliding body and the chain bush may be advantageously designed as a one-piece component.

Sealing elements which are provided between individual plates of the plate link chain prevent external filth from getting into the area of the sliding body.

BRIEF DESCRIPTION OF THE DRAWINGS

The subject of invention is represented in the drawing by means of an exemplary embodiment and is described as follows. Herein.

DETAILED DESCRIPTION OF THE INVENTION

Figure 1:
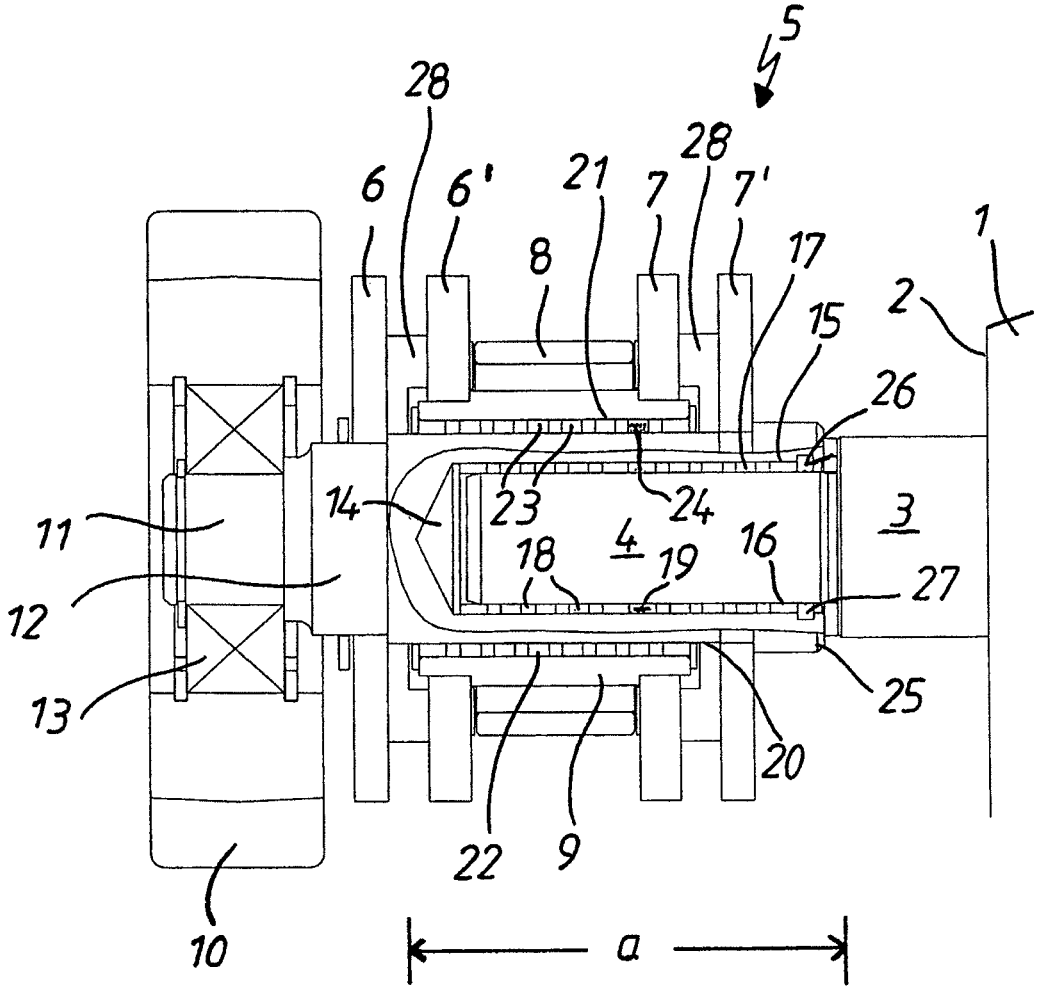
FIG. 1 shows a connection area of a step/pallet to a plate link chain.

FIG. 1 shows a partial representation of a step/pallet 1 of a no further represented escalator or a no further represented moving walkway.

A step connector 3 is provided in the area of each front face 2 of the step/pallet 1, which step connector ends in a shoulder 4 having a smaller diameter. It is not represented that the step connector is received in an eye of the step/pallet 1. The chain 5 which may be a plate link chain and which is the drive element of the steps/pallets 1 of the escalator/moving walkway comprises, apart from plates 6, 6', 7, 7', an external protection roll 8 as well as an internal chain bush 9. A chain roller 10 is provided axially outside the step 1 and the plate link chain 5, which chain roll rests on an end region 11 of a hollow stud pin 12 by means of a bearing 13. The hollow stud 12 comprises a clearance 14 having a pre-determinable axial depth a and is provided for receiving the shoulder 4 of the step connector 3. A slide bearing 17 in the form of a tube, which comprises continuous recesses 18 which serve for receiving a lubricant 19, for example fat, extends radially between the circumferential surface 15 of the clearance 14 and the external circumferential surface 16 of the shoulder 4. Another sliding body 22, analogous to said slide bearing 17, is provided with pockets 23 for receiving fat 24, extends between the outer circumferential surface 20 of the hollow stud 12 and the inner circumferential surface 21 of the chain bush 9. For preventing filth from getting into the area of the slide bearing 17, a disk 26, on the one hand, and a sealing element 27, on the other hand, is positioned on the shoulder 4 between the enlarged portion of the step connector 3 and the free end 25 of the hollow stud 12. In order to prevent filth from outside from getting into the area of the sliding body 22 another sealing body 28 is respectively arranged between the individual plates 6, 6' as well as 7, 7'.

Figure 2:
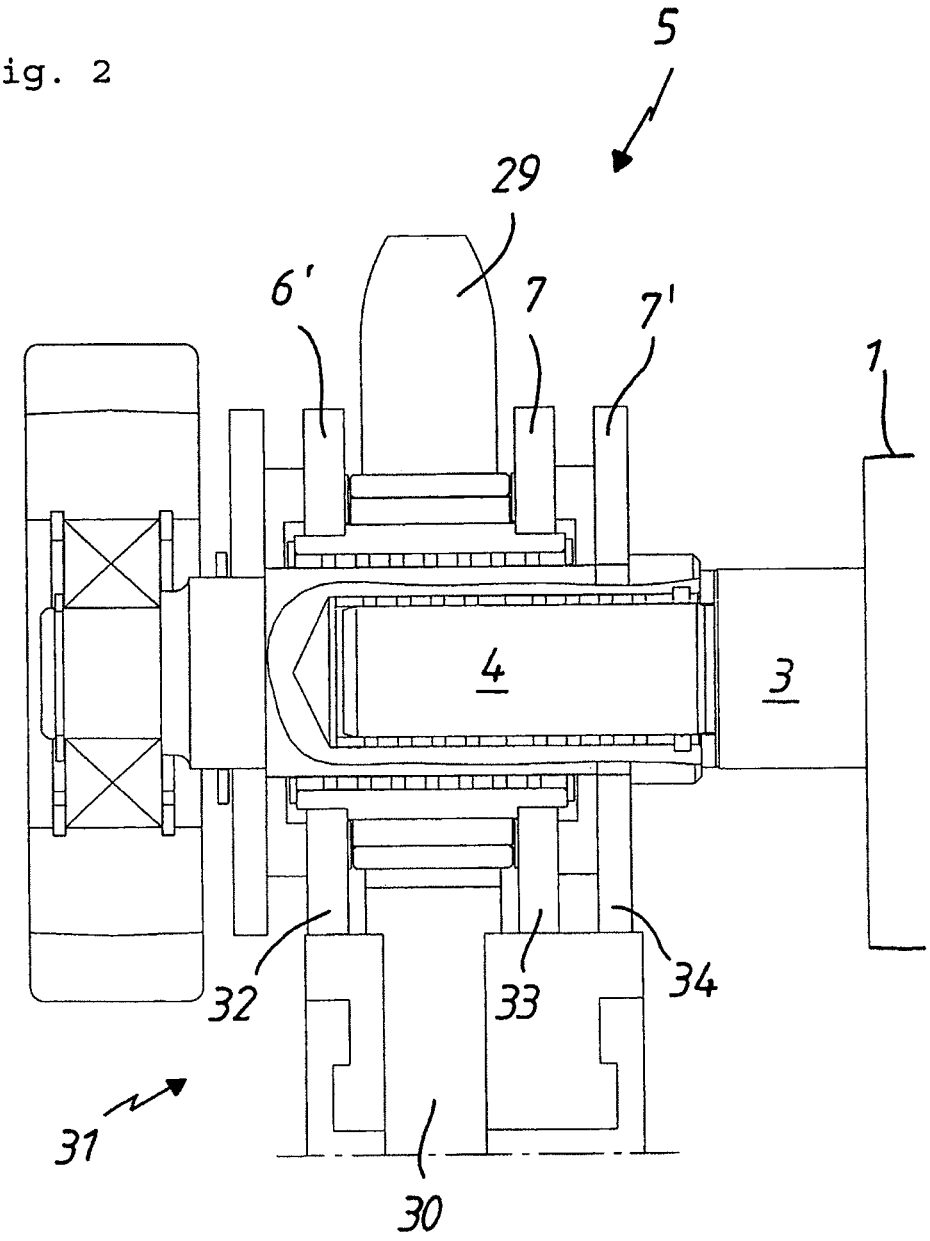
FIG. 2 is a schematic diagram of an area of engagement of a chain wheel tooth into the plate link chain according to FIG. 1.

FIG. 2 corresponds to FIG. 1 with respect to the connection elements between the step/pallet 1 and the chain 5, as well as the roll 10 including the hollow stud 12, as well as the step or pallet connector 3 comprising shoulder 4. The engagement of a tooth 29 of outlined partially shown chain wheel 30 in the plates 6', 7 is complementarily represented in FIG. 2. Axially extending shoulders 32, 33 are actively connected to the area 31 of the chain wheel 30 on the tooth side, which shoulders are positioned so that the lower portions 32, 33, 34 of the plates 6', 7, 7' can rest on them while forming contact lines. Thereby a high smoothness of running of the plate link chain 5 is obtained.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A device for connecting a chain, which is actively connected to a roller, to a step or a pallet of an escalator or a moving walkway, respectively, the chain comprising a plate link chain including first and second pairs of opposing plates, the chain having a roller side and a step or pallet side, the device comprising;

a hollow stud disposed on the roller side and a step or pallet connector ending in a cylindrical shoulder disposed on the step or pallet side, the hollow stud having a clearance to receive the cylindrical shoulder, wherein the hollow stud has an outer circumferential surface;

a slide bearing arranged at least radially between an inner circumferential surface of the hollow stud defining the clearance and an outer circumferential surface of the shoulder; and an outer protection roll and an inner chain bush arranged between the pairs of opposing plates, and a sliding body by which the inner chain bush is actively connected to the outer circumferential surface of the hollow stud.

2. A device according to claim 1, wherein the step or pallet has a connector and the cylindrical shoulder is part of the step or pallet connector.

3. A device according to claim 1, wherein the slide bearing is tube-shaped and has a circumferential extension that includes a plurality of recesses that extend from an outer towards an inner circumferential surface of the slide bearing, and further including a lubricant embedded in the recesses.

4. A device according to claim 1, and further including a radially acting sealing element positioned axially outside the slide bearing in an area proximate the steps or pallets.

5. A device according to claim 4, wherein the step or pallet connector comprises an enlarged portion on the step or pallet facing the chain or pallet side of the chain, the enlarged portion having a larger diameter than the diameter of the cylindrical shoulder, and further including a disk arranged on the cylindrical shoulder axially between the enlarged portion and a free end of the hollow stud.

6. A device according to claim 1, wherein the sliding body comprises a cylindrical tube including a plurality of pockets for receiving lubricant.

7. A device according to claim 1, wherein the sliding body and the chain bush are separate components made of different materials.

8. A device according to claim 1, further comprising at least one sealing body is respectively arranged between individual plates of each pair of plates of the plate link chain outside the ends of the sliding body.

* * * * *